US006488152B1

(12) United States Patent
Steffann

(10) Patent No.: US 6,488,152 B1
(45) Date of Patent: Dec. 3, 2002

(54) PACKAGE

(75) Inventor: Louis Steffann, Langen (DE)

(73) Assignee: Brodrene Hartmann A/S (DK)

( * ) Notice: Subject to any disclaimer, the term of this patent is extended or adjusted under 35 U.S.C. 154(b) by 0 days.

(21) Appl. No.: 09/743,855

(22) PCT Filed: Apr. 20, 1999

(86) PCT No.: PCT/DK99/00217

§ 371 (c)(1),
(2), (4) Date: Jan. 17, 2001

(87) PCT Pub. No.: WO00/03936

PCT Pub. Date: Jan. 27, 2000

(30) Foreign Application Priority Data

Jul. 17, 1998 (EP) ..... 98113324

(51) Int. Cl.[7] ..... B65D 85/34
(52) U.S. Cl. ..... 206/521.1

(58) Field of Search ..... 206/521.1, 521.15, 206/509, 511, 512; 220/4.23, 4.22, 835, 508, 324, 326

(56) References Cited

U.S. PATENT DOCUMENTS

| | | | | |
|---|---|---|---|---|
| 3,185,370 A | * | 5/1965 | Reifers et al. | 162/231 |
| 3,730,420 A | | 5/1973 | Burkett | |
| 4,098,430 A | * | 7/1978 | Mattheis et al. | 220/283 |
| 5,586,677 A | * | 12/1996 | Foos | 206/815 |
| 5,752,615 A | * | 5/1998 | Hofmann et al. | 220/324 |
| 5,848,699 A | * | 12/1998 | Pettersson | 206/521.1 |

* cited by examiner

*Primary Examiner*—David T. Fidei
(74) *Attorney, Agent, or Firm*—Larson & Taylor, PLC

(57) ABSTRACT

Package (1) for receiving agricultural or industrial products to be packed comprising a bottom part (2) and a cover part (3), whereby the cover part (3) is provided with an enlarged side surface.

27 Claims, 7 Drawing Sheets

PACKAGE

BACKGROUND OF THE INVENTION

U.S. Pat. No. 3,536,250 discloses another package similar to the one described above in which the flexible flap is an integral part of the upper part. Between the front surface of the upper part and the flexible flap there is a horizontal surface forming a step between the front surface and the flexible flap forming an abutment surface for arresting the upper part. The front surface of this package is provided with channels and projections forming a mechanism for disengaging the upper part. The irregularities in the front surface which is small as in U.S. Pat. No. 3,370,420 make it very difficult to provide this surface with print or text.

SUMMARY OF THE INVENTION

It is the object of the present invention to provide a package of the kind referred to above, which allows a major part of the side surface of the package to be provided with text or images. The package according to the invention has a front panel on the cover part which overlaps the front of the bottom part. In this way the front panel of the cover part can cover the whole front of the package, thus allowing for an increased surface to provide text or images.

Another object of the invention is to provide a package that is easier to open and close. The front panel of the cover part can be used to hold the cover part in its closed position without the need for a flexible flap as used in the prior art packages. For this purpose the package can be constructed in such a way that the cover part will come into frictional contact with the bottom part at the end of the closing and at the beginning of the opening movement. For the same purpose also projections can be provided on the front of the bottom part. The corresponding holes for receiving the projections will then be located at the lower part of the front panel of the cover part, and therefore they will not be at the most noticeable part of the front of the package so that they do not disturb.

The front panel of the cover part may extend completely down to the bottom part of the package so that it can rest on the surface carrying the package in order to improve the stability of the package. The cover part may be provided with a planar top surface that defines projections to hold a package stacked onto it in place.

According to a preferred embodiment the package is produced by pulp moulding. The packages are moulded and dried with the cover part in its open position. The freshly moulded product is very weak, and it is necessary for the lid to be supported. For this purpose an edge defined by the planar top surface and the front panel of the cover part can be used.

Further advantages and embodiments of the package according to the present invention and the method for producing said package are set forth in the independent claims.

BRIEF DESCRIPTION OF THE DRAWINGS

In the following detailed portion of the present description, the invention will be explained in more detail with reference to the exemplary embodiments of the package according to the invention as shown in the drawings, in which.

DETAILED DESCRIPTION OF THE PREFERRED EMBODIMENTS

Figure 1:
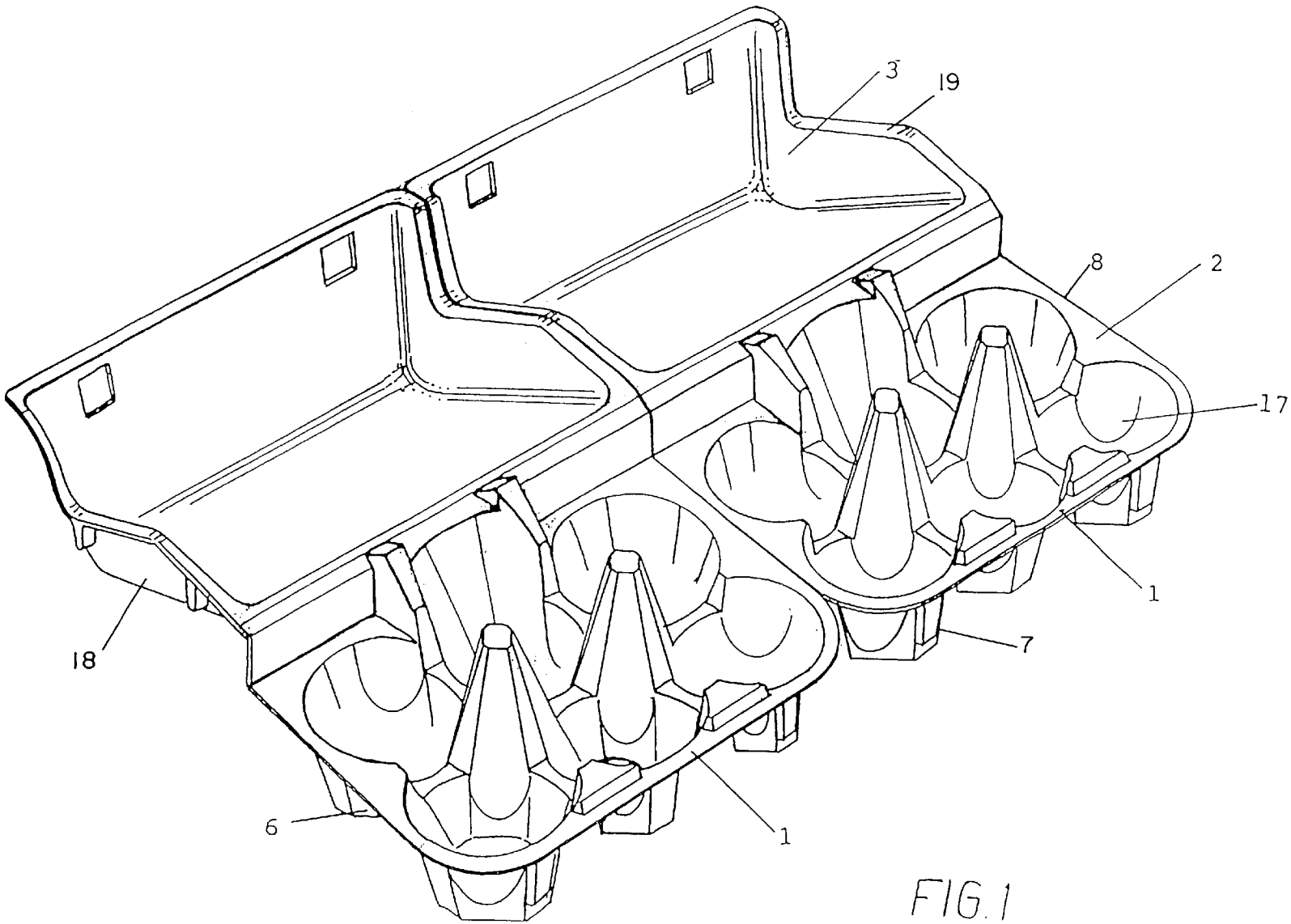
FIG. 1 is a perspective view as seen from above of two packages detachably connected side to side according to the invention.

FIG. 1 shows a pair of packages 1 detachably connected and in their open position. A package consists of a bottom part 2 and a cover part 3. The bottom part is preferably rectangularly shaped and defines a plurality of upwardly open pockets 17 for receiving products to be packed. The bottom part further defines side surfaces 5 to 8. These side surfaces 5 to 8 define the upper edges of the bottom part 2, and they are non-planar in order to define the above-mentioned pockets. The package is provided with a cover part 3 that can take an open and a closed position. The cover part 3 consists of at least a planar top surface 10 and a front surface 4. The front surface 4 and the top surface 10 meet at an angle to form a supporting edge 13 for the cover part to rest on in its open position. The bottom part and the cover part are connected by a hinge 9 located at the upper edge of one of the side surfaces 5 of the bottom part 2 and at the cover part 3 opposite to the side surface 4.

Figure 2:
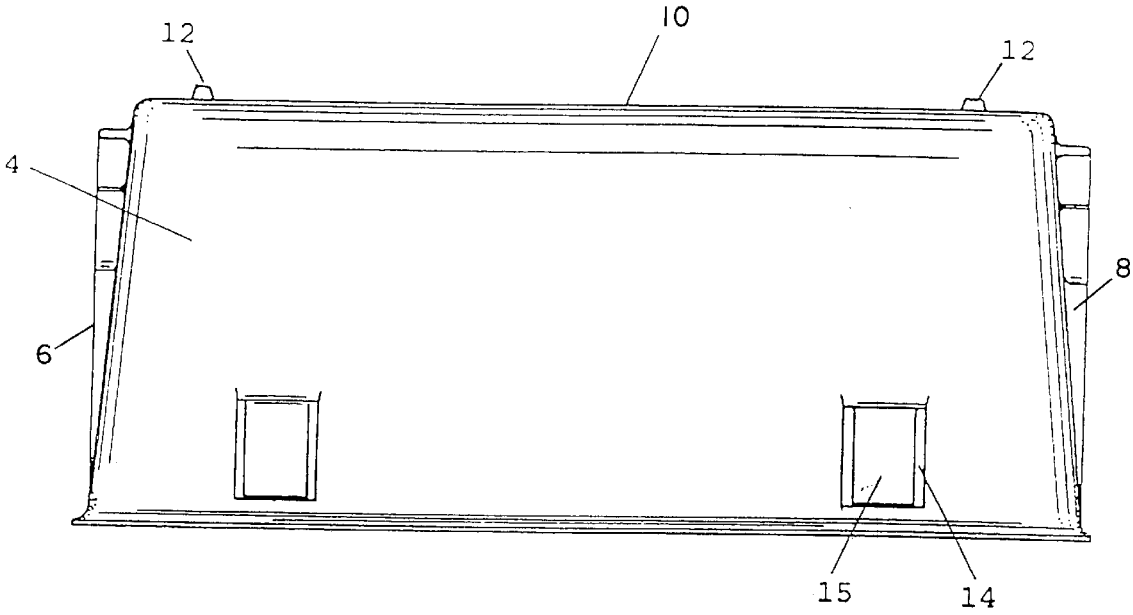
FIG. 2 is a front view of the package with the cover part in its closed position.

FIG. 2 shows a side view with the cover part 3 in its closed position. The front surface 4 extends from the planar top surface 10 down. According to a preferred embodiment, the front surface 4 of the cover extends substantially parallel to and adjacent to the side surface 7. This allows the front surface 4 to be supported by the side surface 7. In the exemplary embodiment, the front surface 4 of the cover part is provided with two holes 14 for receiving projections 15 of the bottom part in order to lock the cover part 3. According to a preferred embodiment, the front surface 4 extends fully down to the bottom of the package so that it may serve as a support for the cover part and allows a more stable construction of the package.

The projections 15 and the corresponding holes 14 are located at the lower part of the package so that they least disturb the front surface 4. In another preferred embodiment (not shown), the inner side of the front panel 4 is provided with ridges that hook to the projections 15 so that the front side 4 is without disturbing holes.

Figure 3:
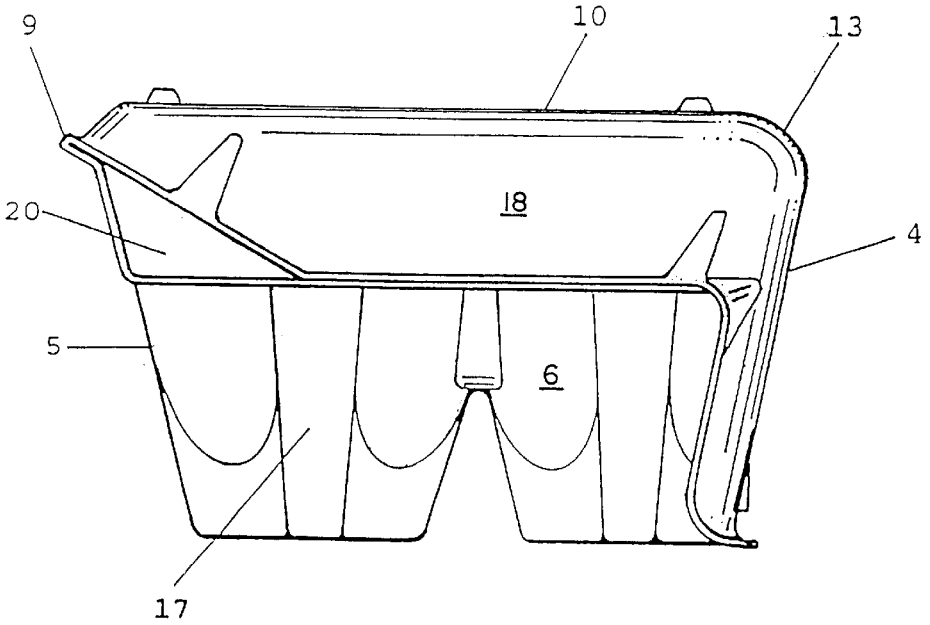
FIG. 3 is a side view of the package with the cover part in its closed position.

Further, FIG. 3 illustrates a side view from which it can be seen that the cover part is provided with side panels 18, 19 extending down to the upper edges of the corresponding side surfaces 6, 8 of the bottom part. The side panels 18, 19 of the cover part are designed such as to form a preferably triangular ventilation opening 20.

In order to be able to remove a package from a mould in which it could be made, it is necessary for the panels to define a certain minimum angle $\alpha$ with the vertical, i.e. with the direction of removal from the mould. This angle α thus poses certain restrictions on the freedom of construction. With the front panel 4 of the cover part 3 parallel and adjacent to the front 7 of the bottom part 2, it is necessary for the hinge to be positioned above half the height of the closed package. The height of the front 7 of the bottom part 2 can extend above the height of the hinge 9 in order to increase the closing pressure. The back 5 of the bottom part extends higher than the front and sides of the bottom part 2 in order to allow the hinge 9 to be positioned higher. Another feature is that the hinge 9 can be connected to the cover part 3 practically at the edge of the planar top surface 10. This allows the planar top surface 10 to be larger and allowing more space for text and images.

Figure 4:
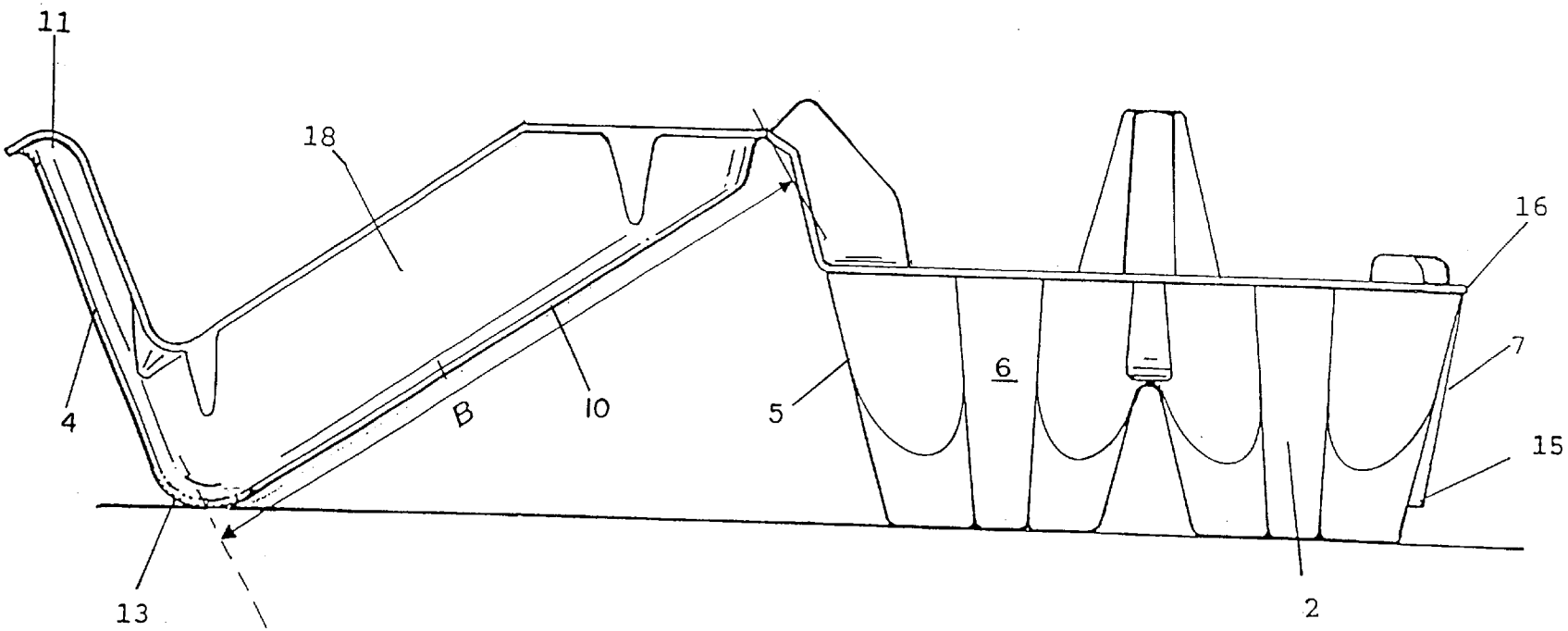
FIG. 4 is the same side view as FIG. 3, but with the cover part in its open position.

FIG. 4 shows the package from the same side as FIG. 3, but with the cover part in its open position. The cover part 3 rests on the edge 13. This support is necessary for a pulp moulded package for providing support for transporting and drying the freshly moulded package. The bottom part 2 may be provided with pillow posts that support the planar top surface 10 in order to improve the stability of the package. In the open position, the front surface 4 of the cover part 3 again forms the minimum angle α with the vertical. If, as in the exemplary embodiment, the front surface 4 is to be parallel to the side surface 7 in the closed position, then the top surface 10 has to form an angle of at least 2α with the horizontal. This can be achieved by locating the hinge 9 at a height corresponding to at least B sin 2α, in which B is the distance from the hinge 9 to the supporting point of the edge 13.

FIGS. 6 to 9 show a second embodiment in which the front panel 4 comprises two rigidly connected planar panel portions 22 and 24. The panel portions 22 and 24 form an obtuse angle with one another.

According to a further embodiment, the tip 11 of the front panel 4 is in physical contact with the upper edge 16 of the front 7 during the last part of the closing movement and the first part of the opening movement, respectively. The cover part 3 can thus be locked to the bottom part without the need for projections and holes. The strength of this physical contact may be varied by:

a) adjusting the height of the front 7, b) adjusting the distance from the hinge 9 to the inside surface of the front panel 4 relative to the distance between the upper edge 16 and the hinge 9.

These two possibilities for adjustment influence the pressure during the closing process as well as the compressive stress in the closed position.

The top surface 10 can be provided with projections 12 that hold a package stacked on the top surface 10 in place.

The package according to the preferred embodiment is an egg-carton. The shown embodiment is a twin-pack of two 6-packs. The egg-carton can also be a 4-pack, a 10-pack or a 12-pack or other common format.

The packages may be produced by moulding pulp mass. In a preferred embodiment, the packages are preferably produced in sets of two packages that are connected detachably at their sides. In order to produce such a package a vacuum-permeable mould surface is provided, followed by aspirating a fibre-pulp mass onto the mould. The freshly moulded packages of wet pulp have a low stability since the wet pulp is very weak. In order to be able to transport the packages from the mould to the drying oven it is therefore necessary that both the bottom part and the cover part have a supporting surface to carry them. This support is naturally available for the bottom part, however for the cover part member such support must be provided. In the present invention this is provided by the edge 13 which is formed by the planar top surface 10 meeting the front surface 4 at an angle. The package may be after-pressed in order to provide a more smooth and appealing outer surface.

Figure 5:
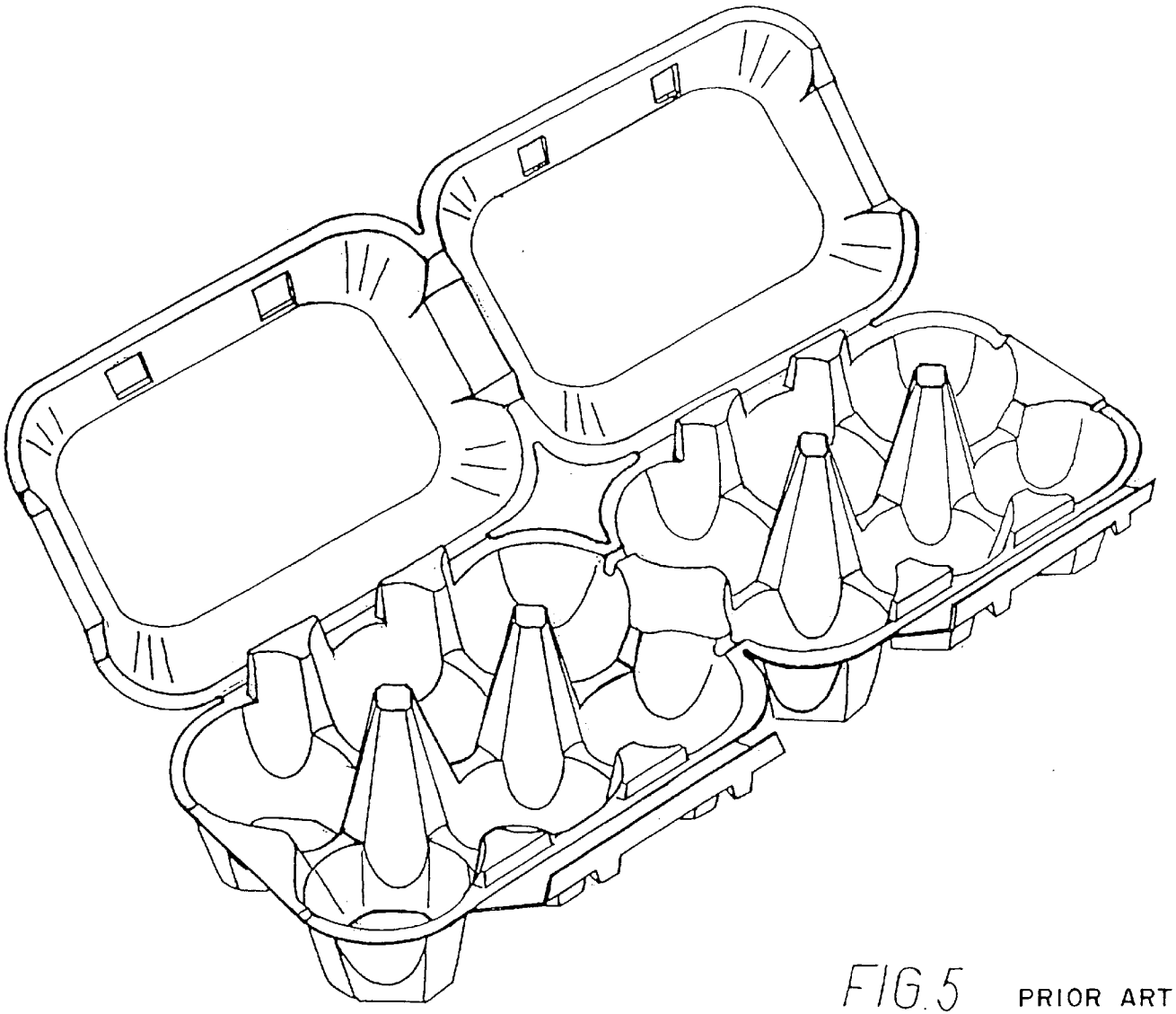
FIG. 5 PRIOR ART
FIG. 5 is a perspective view as seen from above of a prior art package.
Figure 6:
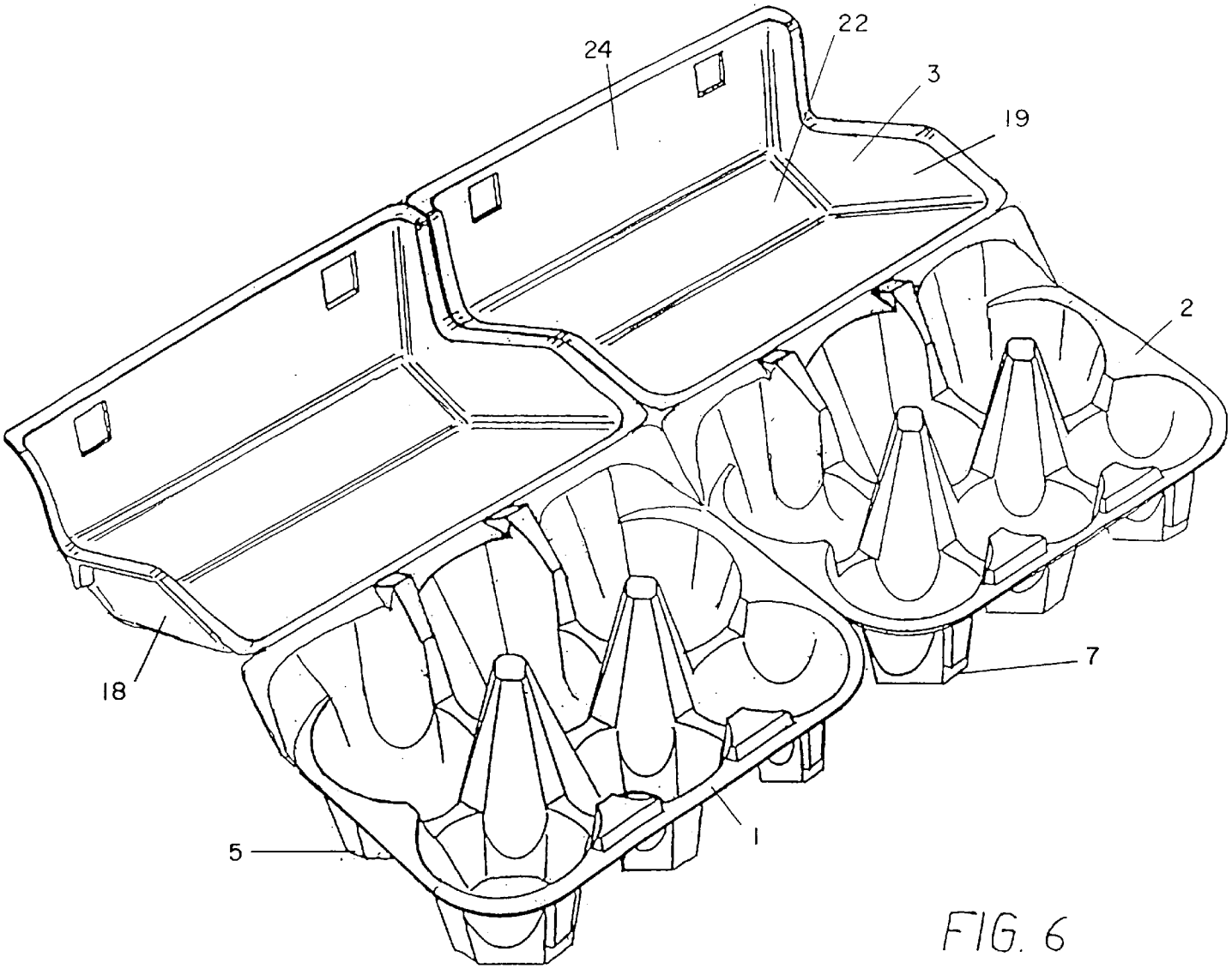
FIG. 6 is a perspective view as seen from above of two packages detachably connected side to side according to the invention of a second embodiment.
Figure 7:
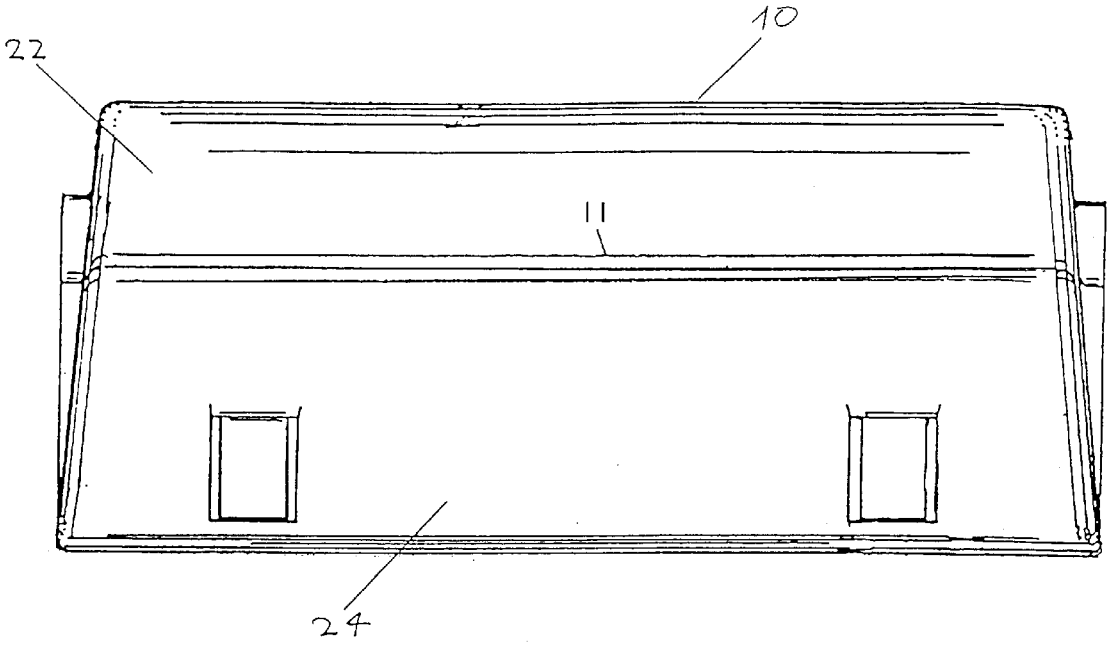
FIG. 7 is a front view of the package with the cover part in its closed position of a second embodiment.
Figure 8:
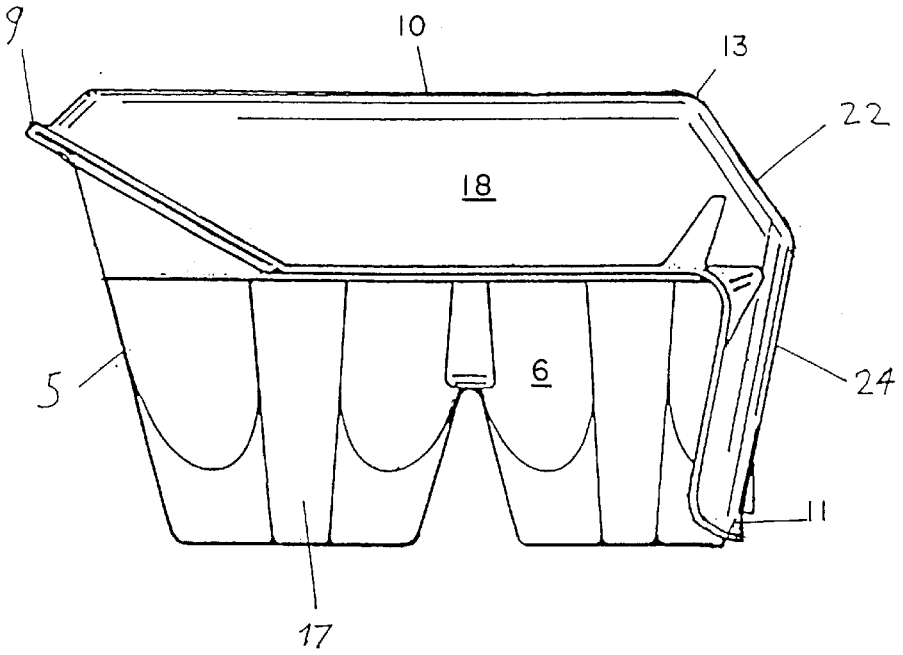
FIG. 8 is a side view of the package with the cover part in its closed position of a second embodiment.
Figure 9:
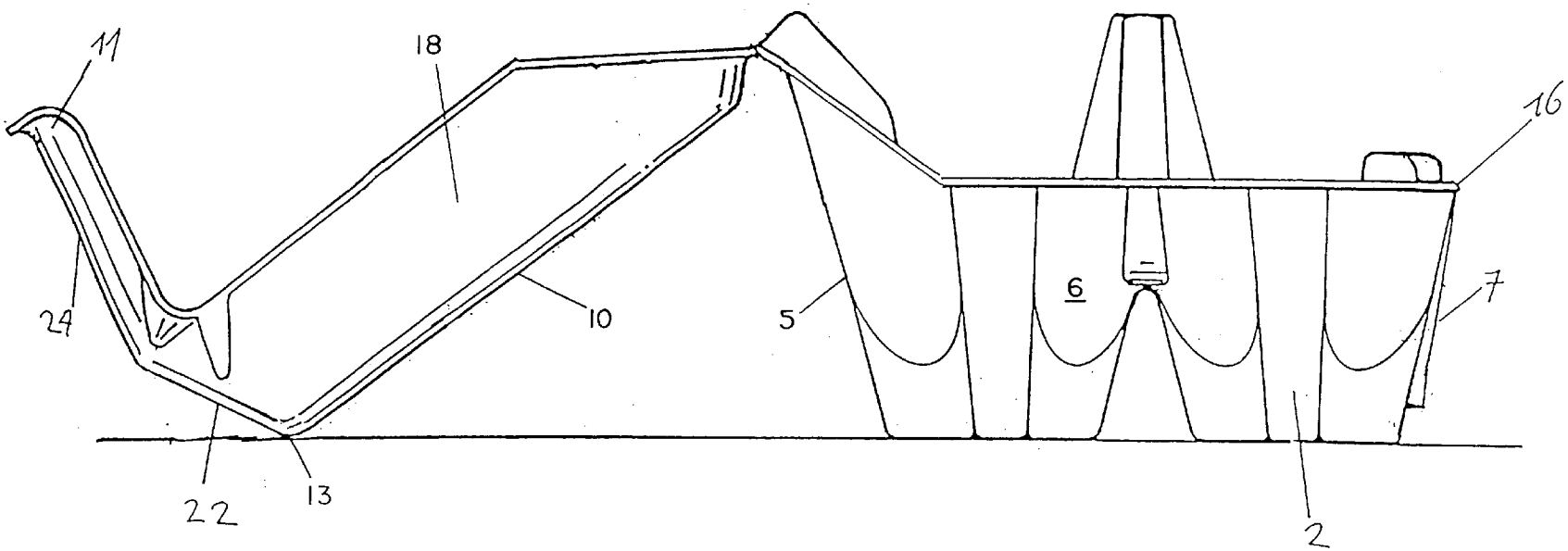
FIG. 9 is the same side view as FIG. 8, but with the cover part in its open position.

FIG. 5 shows a prior art package with flexible flaps attached to the front of the bottom part opposite to the hinge. These flaps pose difficulties to the user when opening and closing the package.

What is claimed is:

1. A package for receiving a plurality of individual products comprising:

a bottom part defining a non-planer front, a back and sides, which non-planer front is shaped to match at least partially the outer contours of the products received by the package, a cover part comprising a top and a front panel meet each other at an edge, the bottom part being connected to the cover part along a hinge on the back of the package and extending parallel to said edge, so as to allow the cover part to move between an opened position and a closed position, and wherein, in the closed position, the front panel extends downwardly from said edge to cover a portion of the front of the package, including a portion of the non-planer front of the bottom part.

2. A package according to claim 1, wherein the back and sides of the bottom part are also non-planer.

3. A package according to claim 1, wherein the front panel extends down to the bottom of the package so that it may rest on the surface carrying the package.

4. A package according to claim 1, wherein the front panel is formed by an upper planer surface and a lower planer surface which are rigidly connected to form an obtuse angle with one another.

5. A package according to claim 1, wherein the front panel is in physical contact with the front of the bottom part during the last part of the closing movement of the cover part and the first part of the opening of the cover part, thereby allowing the cover part to be held in the closed position.

6. A package according to claim 1, wherein the top of the cover part is a planer top surface.

7. A package according to claim 6, wherein the top planer surface defines projections that can receive an hold the bottom part of a package stacked on it.

8. A package according to claim 1, wherein the edge forms a support for the cover part to rest in its fully opened position.

9. A package according to claim 1, wherein the cover part defines side surfaces extending down along the sides of the bottom part when the cover part is in the closed position.

10. A package according to claim 1, wherein the front of the bottom part defines, at the lower part thereof, at least one projection for hooking onto a ridge defined by the front panel, thereby releasably locking the cover part to the front of the bottom part.

11. A package according to claim 1, wherein the front and back of the package form at least a certain minimal angle with the vertical, in order to allow such a package to be removed from a mould in which it is produced.

12. A package according to claim 11, wherein the hinge is located at a height sufficient to allow the outer edge of the front panel which is lowermost in the closed position to pass over the top of the front of the bottom part.

13. A package according to claim 11, wherein the hinge is located at a height sufficient to allow the front panel of the cover part to form said minimum angle with the vertical when the cover part is in the completely opened position.

14. A package according to claim 1, wherein the height of the back of the bottom part is great enough to create a compressive stress between the front of the bottom part and the front panel when the cover part is in the closed position.

15. A package according to claim 1, wherein the bottom part defines a plurality of upwardly open pockets for receiving a product to be packed.

16. A package according to claim 15, wherein the open pockets are shaped to receive eggs.

17. A package according to claim 1, including two packages detachably connected end to end.

18. A package according to claim 1, wherein the package is a moulded product.

19. A package according to claim 18, wherein the package is moulded as one piece.

20. A package according to claim 18, wherein the package is made of moulded pulp.

21. A package according to claim 1, wherein the package is made of a polymer.

22. A package for receiving a plurality of individual products comprising:

a bottom part defining a non-planer front, a back and sides, which non-planer front is shaped to match at least partially the outer contours of the products received by the package, a cover part comprising a top and a front panel which meets each other at an edge, the front panel having upper and lower panel portions which are rigidly connected together at a second edge which is parallel to the first edge, the two panel portions forming an obtuse angle with each other, the bottom part being connected to the cover part along a hinge on the back of the package and extending parallel to said edge, so as to allow the cover part to move between an opened position and a closed position, and wherein, in the closed position the front panel extends downwardly to overlap at least a portion of the front of the bottom part.

23. A package according to claim 22, wherein in the back and sides of the lower part are also non-planer.

24. A package according to claim 22, wherein the front panel extends down to the bottom of the package so that it may rest on the surface carrying the package.

25. A package according to claim 22, wherein the front panel is in physical contact with the front of the bottom part during the last part of the closing movement of the cover part and the first part of the opening of the cover part, thereby allowing the cover part to be held in the closed position.

26. A package according to claim 22, wherein the cover part defines side surfaces extending down along the sides of the bottom part when the cover part is in the closed position.

27. A package according to claim 22, wherein the bottom part defines a plurality of upwardly open pockets shaped to receive eggs.

* * * * *